United States Patent [19]

Logsdon

[11] 4,400,272

[45] Aug. 23, 1983

[54] DRAIN GRATE WITH ADJUSTABLE WEIRS

[76] Inventor: Duane D. Logsdon, 1708 Calavera Dr., Fullerton, Calif. 92631

[21] Appl. No.: 271,501

[22] Filed: Jun. 8, 1981

[51] Int. Cl.[3] ..... E03F 5/14

[52] U.S. Cl. ..... 210/166

[58] Field of Search ..... 210/163, 164, 165, 166

[56] References Cited

U.S. PATENT DOCUMENTS

| | | | |
|---|---|---|---|
| 1,674,347 | 6/1928 | Silverman | 210/166 |
| 1,973,321 | 9/1934 | Schultz | 210/163 |
| 2,666,493 | 1/1954 | Gordon | 210/166 |
| 2,837,212 | 6/1958 | Schmid | 210/165 |
| 3,357,561 | 12/1967 | Schmid et al. | 210/163 |
| 3,469,698 | 9/1969 | Blendermann | 210/163 |
| 3,469,699 | 9/1969 | Blendermann et al. | 210/166 |
| 3,529,723 | 9/1970 | Hagedorn | 210/163 |
| 3,884,809 | 5/1975 | Logsdon | 210/163 |

*Primary Examiner*—Frank A. Spear, Jr.
*Attorney, Agent, or Firm*—K. H. Boswell; Edward D. O'Brian

[57] ABSTRACT

A self supporting grate for a drain structure can be improved by including as part of the grate a mounting base sized and shaped to attach the grate to the drain structure. At least a portion of the grate is formed as a generally upwardly projecting wall attaching to and extending from the base. The wall includes a plurality of weirs capable of forming a variable flow fluid pathway to the interior of the grate for fluid disposal by the drain structure. The weirs are constructed so as to allow fluid at a first fluid level on the wall as measured from the base to flow at a first rate from the exterior of the grate into the interior grate and fluid at a second fluid level likewise measured along the wall from the base to flow at a second rate into the interior of the grate, with the second rate being different from the first rate.

2 Claims, 4 Drawing Figures

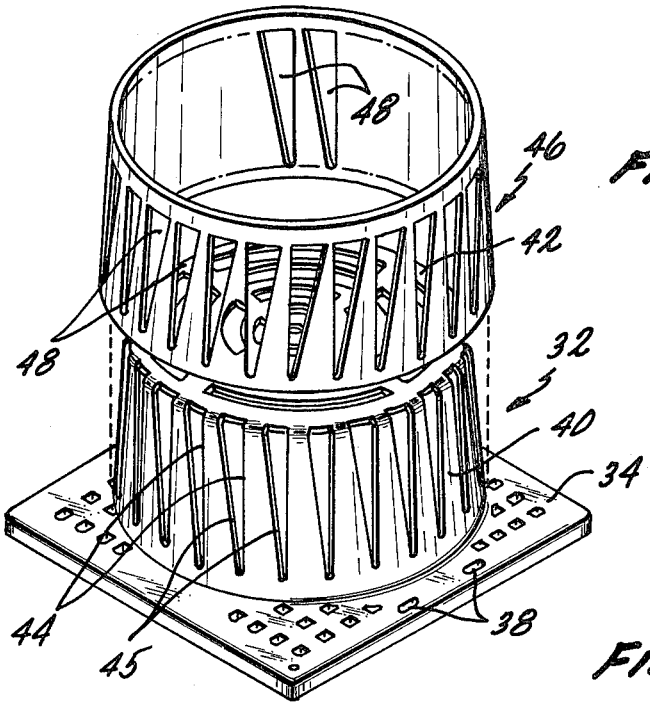
Fig. 3
Fig. 4
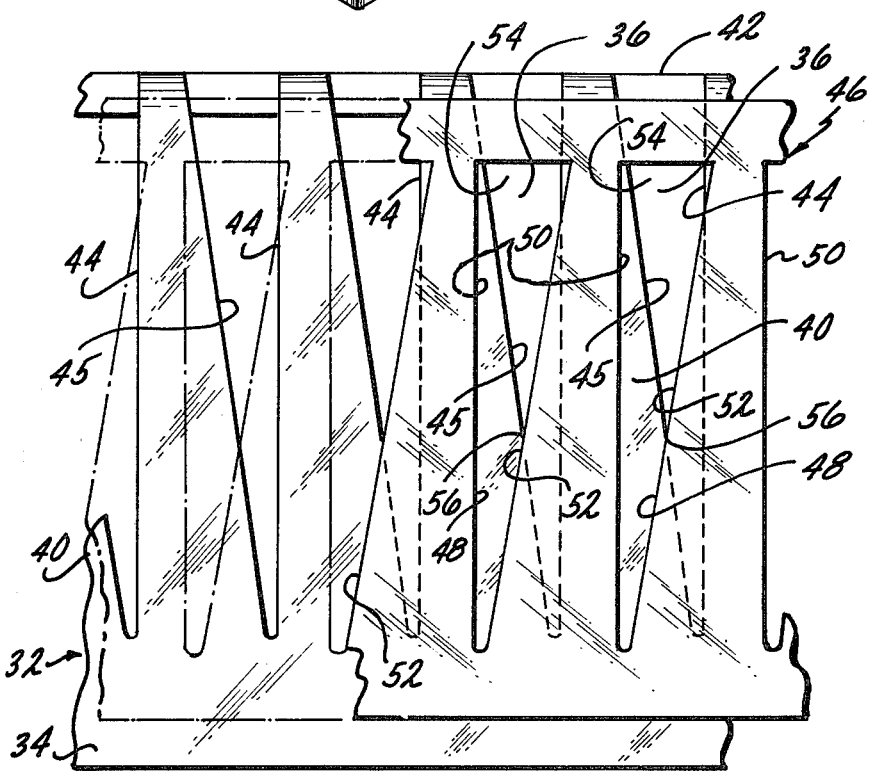

DRAIN GRATE WITH ADJUSTABLE WEIRS

BACKGROUND OF THE INVENTION

This invention is directed to a self-supporting grate for a drain structure. The self-supporting grate is designed such that a variable fluid flow through the grate depending on the height of the fluid to be discharged through the grate is achieved. The variable rate is achieved by the use of a plurality of weirs sized and shaped so as to allow for variable flow rate depending on the depth of the fluid to be removed.

Most flat topped roofs of buildings, houses and the like as well as other structures such as parking lots and the like incorporate grated drain structures for removal of fluid, i.e., water, from the flat area. The grate is incorporated on the drain structure to prevent foreign bodies from being deposited into the drain structure and clogging the draining system and the like. Further, the grates are designed to keep vermin and other such pests from entering or exiting from the drain system.

There presently exists a number of drain structures as, for example, the structure described in my U.S. Pat. No. 3,884,809. In this drain structure a scupper drain is equipped with a self-supporting dome covering the entrance to the portion of the drain which serves to divert fluid from the top of the drain through the drain and into the drain pipe. For use on flat roofed buildings and the like, this type of drain has been found very utilitarian in ease of installation, longevity of the product and prevention of foreign matter into the drain system.

Certain geographical areas are subjected to weather patterns such that within a very short period of time a considerable amount of rainfall occurs resulting in the production of a sizable amount of standing water on structures, paved areas and the like. Since building roofs and the like and parking lots and the like are covered with material impervious to water penetration, the rainfall accumulates on these surfaces at depths depending on the collecting area of the surface as well as the amount of rainfall.

Because of the inability of storm drain systems to handle a large amount of water over a specific time period, heavy rainfall may result in complete overtaxing of the capacity of the storm drain system. In order to combat the problem of either inadequate storm drain capacity of a municipality and/or excessive rainfall over a short period of time, it would be beneficial to have the individual drain structures on each and every building, parking lot or the like be able to govern the influx of run-off into the storm drain system such that the storm drain system could operate at full capacity but would not be overtaxed or oversaturated such that erratic water removal and/or damage to the storm drain system resulted.

The grates utilized on all existing drain structures is that as is typically illustrated in the above noted patent. The noted patent utilizes a drain having a foraminous grate. This grate is formed by including a plurality of equally sized slots or openings in the grate. These slots or openings extend from an area adjacent to where the grate fits onto the scupper drain structure and up to and including the crown or uppermost periphery of the grate. In other grates, such as flat grates, the openings would be evenly spaced over the surface of the grate. It is obvious that within this type of grate system there can be no specificity with regard to flow rate, of the water or other fluid through the grate.

In order to logically and efficiently remove large amounts of standing water on structures served by drains it is evident that new and improved grate structures must be developed. Further, in order to maintain economy of construction, new and improved grates are needed which are capable of having variable flow rates which can comply with local ordinances governing the flow rate of water input into a storm drain system.

BRIEF DESCRIPTION OF THE INVENTION

In view of the above, it is recognized that there exists a need for new and improved grate structures. It is therefore a very broad object of this invention to provide such a grate structure which fulfills these needs. It is a further object of this invention to provide a grate structure formed of easily attainable and workable materials such that the grate structure as manufactured will be economical to the producer and can be installed with a minimum expenditure of valuable and expensive labor time. It is a further object to provide a grate structure which because of its construction will hold up to the wear and tear of being exposed to the elements as well as to any stresses placed upon it by other influences in the environment such as influx of traffic through the area where the grate structure is located.

These and other objects as will be evident from the remainder of this specification are achieved in an improvement in a self-supporting foraminous grate for a drain structure which comprises; said grate including a mounting base, said base sized and shaped to attach to said drain structure maintaining said grate on said drain structure; said grate having an exterior and an interior, said exterior of said grate communicating with the ambient environment, said interior of said grate communicating with said drain structure such that fluid in the interior of said grate passes through said drain structure; at least a portion of said grate formed as a generally upwardly projecting wall means attaching to and extending from said base; said wall means including a variable flow weir means, said weir means forming a pathway for fluid flow from the exterior of said grate into the interior of said grate; said weir means constructed so as to allow fluid at a first fluid level on said wall means measured from said base to flow at a first rate from the exterior of said grate into the interior of said grate and fluid at at least a second fluid level on said wall means measured from said base to flow from the exterior of said grate into the interior of said grate at a rate differing from said first rate.

The weir means can comprise a plurality of elongated weirs extending into the wall means from a location proximate to the base to a location distal from the base. As so constructed the weirs each comprise an opening in the grate between the exterior of the grate and the interior of the grate. The opening would have a first width at a first fluid level and a second width at a second fluid level and at least one intermediate width at a level intermediate the first and second fluid levels.

Preferably, the weirs taper from a wide width at a point distal to the base to a narrow width at a point proximate to the base. It is preferable that at least a portion of the grate be shaped as a surface of revolution and the wall means form at least a portion of this surface of revolution. Further, the surface of revolution can be truncated such that a top surface is formed. Such a top surface would be integrally formed with the upper most periphery of the wall. This surface of revolution can be formed as any one of a conventional number of surfaces of revolutions such as cylinders, conics, spheres or the like.

The bottom most portion of the weirs or that portion located proximate to the base is preferably variable in position such that it can move between a position immediately adjacent to the base to a position incidental with the distal location. The area formed between this bottommost portion of the weirs and the base forms a dam wall which is imperforate to fluid and, therefore, is able to retain a particular height (or depth) of fluid from passing through the weirs into the interior of the grate. The height of the dam wall would be directly variable with respect to the position of the lowermost portion of the weir.

In order to accomplish the variability of the lowermost portion of the weir, the wall means can include a first member formed as a surface of revolution and a second member formed as an identical surface of revolution mimicking the shape of the first member with the exception that the second member is slightly oversized with respect to the first member and thus is capable of fitting around the first member and being intimately associated with the first member. The second member would be rotatably mounted on the first member to rotate about the axis of rotation of the surface of rotation of the first member. The first member would include a plurality of wedge shaped openings such that at least one of the edges of the wedge is incanted to the right or left from a line perpendicular to the base and the second member would include an identical plurality of wedge shaped members except it would have an edge which would be incanted to the other direction with respect to the line perpendicular to the base. These two edges would form an opening at least a portion of which is triangular shaped and the apex of this triangular shaped portion would be oriented towards the base. The apex of the triangular portion would be movable toward and away from the base with respect to rotation of the second member on the first member.

BRIEF DESCRIPTION OF THE DRAWINGS

The invention described in this specification will be better understood when taken in conjunction with the drawings wherein:

FIG. 3 is an exploded oblique view of an alternate embodiment of the invention;

FIG. 4 is a side elevational view of a portion of the grate of FIG. 3 in its functional position with the right hand section of the figure showing the outside member in solid lines and the hidden part of the inside member in dash lines and the left hand section of the figure showing the inside member in solid lines with the outside member removed but it's position if it were not removed being shown in phantom lines.

Figure 1:
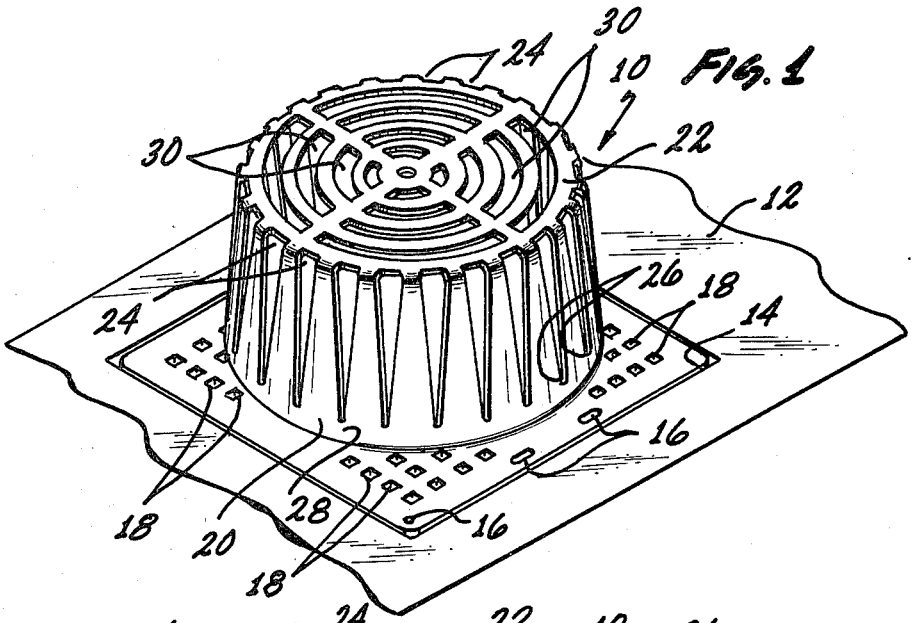
FIG. 1 is an oblique view showing a first embodiment of the invention and portions of the drain structure on which it is located.

This invention utilizes certain principles and/or concepts as are set forth in the claims appended to this specification. Those skilled in the plumbing arts will realize that these principles and/or concepts are capable of being expressed in a number of embodiments differing from the illustrated embodiments described in this specification and shown in the drawings. For this reason, this invention is to be construed only in light of the claims and is not to be construed as being limited to the exact embodiments used herein for illustrative purposes only.

DETAILED DESCRIPTION

In FIG. 1 there is shown a first embodiment of a grate 10 fitting on a portion of a drain structure 12. The drain structure 12 can be any one of a number of similar drain structures such as that described in my U.S. Pat. No. 3,884,809, the entire disclosure of which is herein incorporated. This type of drain has a recessed area in it which accepts the base portion 14 of the grate 10.

The base portion 14 of the grate 10 would include one or more holes collectively identified by the numeral 16 allowing for convenient attachment of the grate 10 to the drain 12. Appropriate screws or the like are simply passed through the holes 16 and screwed into the drain structure 12. Preferably, the base portion 14 is square or rectangular in shape such that it can easily and conveniently be located into a square or rectangular shaped depression within the drain structure 12. A plurality of perculator holes collectively identified by the numeral 18 are also provided in the base 14. These perculator holes serve to remove the last remaining portion of water which has been deposited on the drain structure 12. The perculator holes 18 are sized and shaped such that small gravel or other foreign particles cannot pass through the perculator holes and they are designed to only handle limited amounts of fluid flow, i.e., water removal from the structure which is being served by the drain structure 12. As is described in my above noted patent, the drain 12 would incorporate a suitable collecting basin immediately below the base 14 portion of the grate 10.

Figure 2:
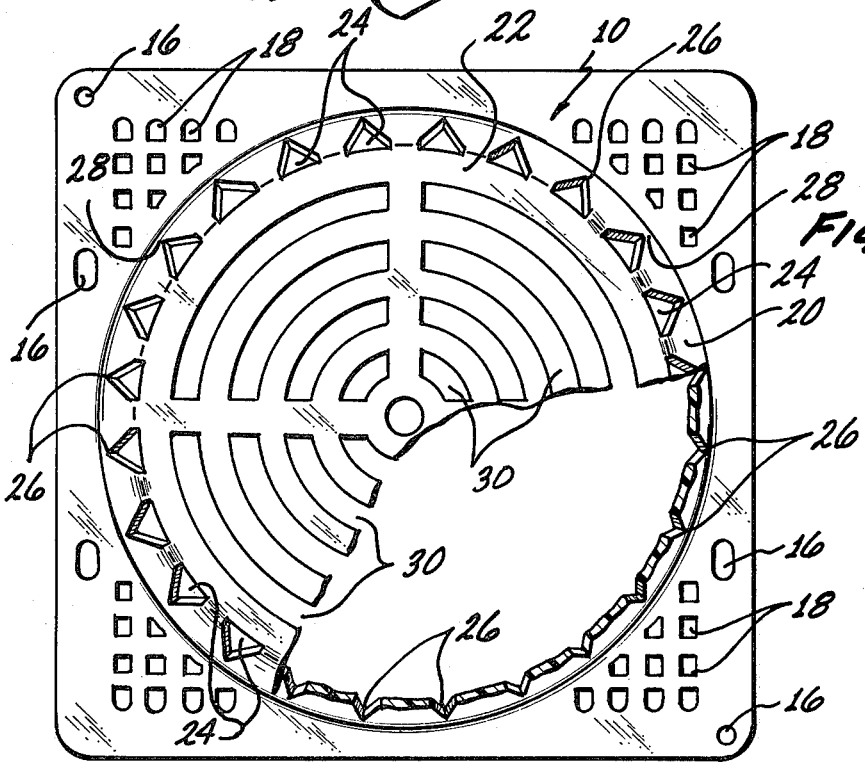
FIG. 2 is a top plan view in partial section of the grate of FIG. 1.

Projecting upwardly from the base 14 as seen in FIGS. 1 and 2 is a truncated conical shaped section. As part of this would be the wall 20 and top 22. The wall 20 and the top 22 are integrally formed with the base 14 preferably by a suitable molding technique. Normally, the grate 10 and other grates as herein described would be formed of a high impact ABS plastic with an acrylic surface for ultraviolet protection. Such material has been found to be very resistant to the weather and elements. Additionally, it is lightweight and easy to store and handle.

Symmetrically spaced around the wall 20 are a plurality of weirs collectively identified by the numeral 24. As can be seen in FIGS. 1 and 2 the weirs 24 are shaped as upsidedown elongated isosceles triangles. The apex formed by the smallest angle of these isosceles triangles is pointed toward the base, that is it is proximal to the base, with the base of the isosceles triangle located near the junction of the wall 20 and the top 22 distal from the base 14.

When water builds up on a surface served by the drain 14, the water will assume a particular depth depending upon the rate of accumulation of water. Prior to the water depth reaching the apex 26 of the weirs 24 the only water removed by the drain 12 will be that passing through the perculator holes 18. When the water depth along the wall 20 as measured from the base 14 reaches the apex 26 the water will start flowing from the exterior of the grate 10 through the weirs 24 into the interior of the grate 10. Depending on the depth of the water above the base 14, the water will be exposed to an opening having a varying area governed by that portion of the weir 24 which is below the depth of the water. Because of the shape of the weir and the area increase of its opening as it extends from the base 24 toward the top 22, flow rate of water or other fluid through the weirs 24 will be dependent upon the depth of this water above the base 14. Flow rate through only the apex 26 portion of the weir will be quite slow and will be at a first rate whereas flow rate when the water is at a height almost to the top 22 will be sufficiently greater at a second rate.

If, for example, the apex 26 was positioned one-half inch above the base 14 the weirs 24 would start discharging water at a time when the standing water on the drain 12 met or exceeded one half inch. As the water depth increased the flow rate would also increase, thus, metering the flow rate of the water through the weirs 24 depending on its depth above the base 14.

The area 28 of the wall 20 between the apex 26 and the base 14 constitutes an inperforate area not subjected to fluid passage therethrough. Small particles of gravel and the like since they are denser than water will be prevented from entering through the weirs 24 into the drain 12 by the presence of this area 28. This will prevent clogging or accumulation of a large amount of debris into the storm drain system served by the grate 10 and drain 12.

The top 22 includes a plurality of openings collectively identified by the numerals 30 which serve to allow for fluid flow through the grate 10 into the storm sewer if and when the height of water above the base 14 exceeds the height of the wall 20. This serves to prevent large accumulations of water onto the roofs of structures which might exceed their structural capacity and the like. An amount of rainfall necessary to exceed the height of the wall 20, however, is considered to be out of the ordinary and normally discharge of water through the grate 10 will be achieved through the weirs 24 augmented by the perculator holes 18. In the embodiments shown in FIGS. 1 and 2 the weirs 24 are of a fixed size and shape and are suitable for standardization to any codes by manufacturing according to such standardization.

In the embodiment depicted in FIGS. 3 and 4 the grate 32 having a base 34 is designed such that the weirs 36, as seen in FIG. 4, are adjustable upon installation of the grate 32. The base 34 includes suitable perculator holes 38 identical to the perculator holes described above. The base 34 is shaped and sized as was the base 14 for incorporation into a suitable drain structure 12.

The grate 32 includes a first member 40 which is integrally formed with the base 34 and includes a top 42. The first member 40 along with the top 42 and the base 34 are essentially identical to the embodiment depicted in FIGS. 1 and 2 with the exception that instead of having the weirs 36 shaped as isosceles triangles they are shaped as elongated right triangles with one of their edges 44 co-planar with a line perpendicular to the base 14 and with a second edge 45 being acute to such a line perpendicular to the base 34. It is obvious that the weirs 24 depicted in the embodiment of FIGS. 1 and 2 could be formed as per the weirs 36 in the embodiments of FIGS. 3 and 4 without departing from their function or the like. As with the isosceles triangle shaped weirs 24 the right triangular shaped weirs 36 would have variable areas depending on water height measure from the base 34.

A second member 46 is designed to fit over and around the first member 40. The second member 46 as depicted in FIGS. 3 and 4 is formed as a truncated conic of a slightly larger radius than the truncated conic forming the first member 40. This allows the second member 46 to fit down onto the first member 40 in an intimate relationship while still allowing the second member 46 to be rotated with respect to the first member 40.

The second member 46 contains a plurality of weirs collectively identified by the numeral 48 equal in number to the number of weirs 36. The weirs 48 are spaced around the second member 46 utilizing the same equal spacing as the weirs 36 in the first member 40. The weirs 48 differ from the weirs 36, however, in that while also being shaped as a right triangle the edge 50 i.e., the acute edge, is directed opposite of the edge 50. That is, while in the illustrative embodiment of FIG. 3 the edge 45 inclines to the left, the edge 50 inclines to the right. The edge 52 of the weirs 48 is, in fact, parallel with the edge 44 of the weirs 46 as can be seen in FIG. 4 when the grate 32 is assembled and functioning.

The two weirs 48 and 36 together combine to form an opening 54 at least a portion of which is triangular shaped as is seen in FIG. 4. The opening 54 has an apex 56 which is variable with respect to the base 34. Rotation of the second member 46 with respect to the first member 40 raises or lowers the apex 56. As seen in FIGS. 3 and 4 if, in fact, the member 46 is rotated counterclockwise as seen in the figures, the apex 56 will descend downwardly toward the base 34 and if the member 46 is rotated clockwise the apex 56 descends upwardly away from the base 34.

The member 46 can be sized and shaped such that it is capable of frictionally engaging with the member 40 upon installation of the grate 34. Preferably, however, depending on local codes and the like the member 46 would be set with respect to the member 40 such that the apex 56 would be a particular height above the base 34. Upon installation of the member 46 over the member 40, suitable solvent would be included on their abutting surfaces such that upon drying of the solvent the position of the apex 56 would become fixed with respect to the base 34, thus, complying with any local codes governing the minimum water depth at which the drain starts to function other than the perculation through the perculator holes 38.

In FIG. 4, to the right hand side of the figure, it can be seen that the weirs 48 are shown in their totality with the weirs 36 shown either as seen in solid line or as hidden in dotted line. To the left of the figure the outline of the weirs 48 remains, however, the member 46 is removed such that the shape of the weirs 36 is evident.

For both the grate 10 and the grate 32 illustrated herein a truncated conical shape has been utilized for the grates. This truncated conical shape is, in effect, a surface of revolution. Other suitable surfaces of revolution such as a cylindrical surface or a hemispherical surface could also be utilized for these grates. If a cylindrical surface is chosen, both the first member 40 and the second member 46 of the grate 32 would be sized such that the inside diameter of the member 46 is fractionally larger than the outside diameter of the member 40. If the members 40 and 46 are formed as conics as is seen in FIGS. 3 and 4, the conics, of course, would have the same slant or angle with respect to the side wall and the base such that the members appropriately intimately mated when they were placed one on the other. If a hemispherical shape was chosen for the grates 10 or 32 the radius of the outside of the first member 40 would be slightly less than the radius of the inside of the member 46 such that the member 46 conveniently fit over the member 40. If hemispherical shapes were chosen there would be no need for the top 22 and 42 as these would simply be extensions of the wall.

As illustrated, the conical shape is truncated, however, this is not necessary. A combination of a full conic or a conic with a rounded or domed top could also be utilized. Since, however, the height of the grates 10 or 32 would normally be measured in inches it would be a waste of material to extend the grates as full conics. As such, the truncated conics of the figures would be the preferred shape of the invention.

I claim:

1. In a self supporting foraminous grate for a drain structure an improvement which comprises:

said grate integrally formed as a one piece structure;

a portion of said grate formed as a mounting base, said base sized and shaped to attach to said drain structure maintaining said grate in said drain structure;

a further portion of said grate formed as a generally upwardly projecting wall integrally formed with and extending upwardly from said base, said wall formed as a continuous surface of revolution;

the remaining portion of said grate formed as a top surface integrally formed on the uppermost periphery of said wall, said top surface including a plurality of openings in said top surface;

said grate having an exterior and an interior, said exterior of said grate communicating with the ambient environment, said interior of said grate communicating with said drain structure such that fluid in the interior of said grate passes into said drain structure;

a plurality of weirs located in said wall in a symmetrical array around the surface of revolution of said wall, each of said weirs shaped as an elongated triangle with the base of each of said triangles located proximal to said top surface and the apex of each of said triangles located proximal to said base so as to allow fluid at a first fluid level on said wall proximal to said base to flow at a first rate from the exterior of said grate into the interior of said grate and fluid at a second fluid level on said wall displaced upwardly from said base from said first fluid level to flow at a second rate which is greater than the first rate;

a fluid imperforate area located on said wall and extending between said base and the apex of each of said triangular shaped weirs, said imperforate area forming a dam wall between the exterior of said grate and the interior of said grate inhibiting fluid flow into the interior of said grate;

a member formed as a surface of revolution mimicking the shape of said surface of revolution of said wall and sized to fit around said wall in intimate association with said wall and rotatably movable on said wall about the axis of rotation on said surface of revolution and including a plurality of weirs located in said member in a symmetrical array, each of said plurality of weirs located in said member shaped as an elongated triangle with the base of said triangles located proximal to said top surface of said grate when said member is located around said wall, together one of said triangular weirs in said wall and one of said triangular weirs in said member forming a wedged shaped opening through said member and said wall into the interior of said grate.

2. The grate of claim 1 wherein:

one of the edges of each of the triangular shaped weirs in said wall forms an acute angle to a line which is perpendicular to said base with said edge being positioned to one of the right or the left of said perpendicular line, one of the edges in each of the triangular weirs in said member forms an acute angle to a line which is perpendicular to said base with said edge being positioned to the other of said right or left of said perpendicular lines, together said one of said edges of said triangular shaped weir in said wall and said one of said edges of said triangular shaped weir in said member forming two sides of an opening which is also triangular in shape with the apex of said triangular shaped opening directed towards said base and the location of said apex of said triangular shaped opening with respect to its distance from said base variable in response to rotation of said member on said wall.

* * * * *